US008412063B2

(12) United States Patent
Obara et al.

(10) Patent No.: US 8,412,063 B2
(45) Date of Patent: Apr. 2, 2013

(54) IMAGE FORMING APPARATUS THAT PERFORMS IMAGE STABILIZATION CONTROL

(75) Inventors: Mitsuru Obara, Toyohashi (JP); Soh Hirota, Toyokawa (JP); Hironori Akashi, Okazaki (JP); Takashi Harashima, Sagamihara (JP); Kanako Kibihara, Toyokawa (JP)

(73) Assignee: Konica Minolta Business Techologies, Inc., Chiyoda-Ku, Tokyo (JP)

( * ) Notice: Subject to any disclaimer, the term of this patent is extended or adjusted under 35 U.S.C. 154(b) by 314 days.

(21) Appl. No.: 12/842,501

(22) Filed: Jul. 23, 2010

(65) Prior Publication Data

US 2011/0020022 A1 Jan. 27, 2011

(30) Foreign Application Priority Data

Jul. 25, 2009 (JP) ..... 2009-173769
Jul. 25, 2009 (JP) ..... 2009-173770

(51) Int. Cl.
*G03G 15/00* (2006.01)

(52) U.S. Cl. ..... 399/49

(58) Field of Classification Search ..... 399/49, 399/301
See application file for complete search history.

(56) References Cited

U.S. PATENT DOCUMENTS

| | | | |
|---|---|---|---|
| 7,417,651 | B2 | 8/2008 | Kawada et al. |
| 7,813,660 | B2 | 10/2010 | Takahashi et al. |

FOREIGN PATENT DOCUMENTS

| | | | |
|---|---|---|---|
| JP | 2002-14505 | A | 1/2002 |
| JP | 2003-023526 | | 1/2003 |
| JP | 2003-255628 | | 9/2003 |
| JP | 2005-321569 | A | 11/2005 |
| JP | 2005-352291 | | 12/2005 |
| JP | 2006-189625 | | 7/2006 |
| JP | 2006-251686 | | 9/2006 |
| JP | 2006-276662 | | 10/2006 |
| JP | 2007-010745 | | 1/2007 |
| JP | 2008-107802 | | 5/2008 |
| JP | 2008-287036 | | 11/2008 |
| JP | 2008-287075 | | 11/2008 |
| JP | 2010-113286 | | 5/2010 |

OTHER PUBLICATIONS

Office Action (Notification of Reasons for Refusal) dated Apr. 26, 2011, issued in the corresponding Japanese Patent Application No. 2009-173770, and an English Translation thereof.
Office Action (Notification of Reasons for Refusal) dated May 10, 2011, issued in the corresponding Japanese Patent Application No. 2009-173769, and an English Translation thereof.

*Primary Examiner* — Quana M Grainger
(74) *Attorney, Agent, or Firm* — Buchanan Ingersoll & Rooney PC

(57) ABSTRACT

An image forming apparatus has an image bearing member that moves at a specified speed; a toner pattern forming section for forming toner patterns of a specified type on the image bearing member under specified image forming conditions; a toner pattern detection member for detecting the toner patterns formed on the image bearing member; a toner amount varying section for varying a target amount of toner to adhere to the toner patterns; and a control section that calculates a toner adherence amount and a toner adherence position from detection results outputted from the toner pattern detection member and that performs image stabilization control to adjust the image forming conditions based on the calculation results. In the image stabilization control, the control section uses detection results of the same toner patterns both to calculate the toner adherence amount and to calculate the toner adherence position.

20 Claims, 16 Drawing Sheets

Prior Art

Prior Art

IMAGE FORMING APPARATUS THAT PERFORMS IMAGE STABILIZATION CONTROL

This application is based on Japanese Patent Application No. 2009-173769 filed on Jul. 25, 2009 and Japanese Patent Application No. 2009-173770 filed on Jul. 25, 2009, the contents of which are incorporated herein by reference.

BACKGROUND OF THE INVENTION

1. Field of the Invention

The present invention relates to an image forming apparatus, and more particularly to an image forming apparatus that finally transfers a toner image onto a sheet of a recording medium by an electrophorographic method, an electrostatic recording method, an ionogrphic method, a magnetic recording method or the like.

In a full-color electrophotographic printers are generally of a tandem type, in which process units for forming a Y (yellow) image, an M (magenta) image, a C (cyan) image and a K (black) image, respectively, are juxtaposed by the side of a sheet path in which recording sheets travel. In each of the process units, a photosensitive drum is irradiated with a light modulated in accordance with image data, whereby an electrostatic latent image is formed on the photosensitive drum, and the electrostatic latent image is developed into a toner image. Then, the toner images formed on the respective photosensitive drums are transferred onto an intermediate transfer belt to be combined with each other (first transfer), whereby a composite full-color image is formed. Thereafter, the composite full-color image is transferred from the intermediate transfer belt onto a recording sheet (second transfer), and the toner image is fixed on the recording sheet by heat.

In this kind of image forming apparatus, in order to form an image with a desired color tone by combining toner images of the respective colors with accurately controlled densities, toner adherence control and halftone density control are performed. More specifically, first, toner adherence control with the maximum density values of the respective colors set as the target values is carried out, and then, halftone density control is carried out to update a look-up table such that the density of a solid image and the density of a halftone image keep linearity. Further, in order to prevent misalignment of colors due to errors in mechanical accuracy of the respective process units, color registration control is carried out. In the color registration control, test patterns are formed, the amounts of misalignment of colors are detected, and the misalignment is corrected. These kinds of control are collectively referred to as image stabilization control. The image stabilization control is carried out when the image density and the color registration are expected to come out of the allowable range. For example, when the circumferences change largely or when an expendable item is changed, the image stabilization control is carried out.

In the following, the density control is described with reference to FIGS. 15 and 16. In the density control, the process units form solid toner patterns of a specified shape under specified image forming conditions and transfer the toner patterns onto the intermediate transfer belt, and the toner patterns are detected optically.

FIG. 15 schematically shows an example of formation of toner patterns on the intermediate transfer belt 21 for toner adherence control. FIG. 16 schematically shows an example of formation of toner patterns for halftone density control. In FIGS. 15 and 16, the letters "Y", "M", "C" and "K" attached to the numbers indicating the toner patterns mean yellow, magenta, cyan and black, respectively. In the following paragraphs, also, the letters "Y", "M", "C" and "K" mean these colors. The arrow "Z" shows the direction in which the intermediate transfer belt 21 rotates (which will be also referred to as a sub-scanning direction), and a direction perpendicular to the direction Z is referred to as a main-scanning direction. The toner patterns are detected by optical sensors SE1, each of which is composed of a light emitting element and a light receiving element.

The toner patterns 101 to 104 for the toner adherence control are formed in accordance with the same image data, with the developing bias voltage varied. The optical sensors SE1 detect the densities of the respective toner images, and the optimal developing bias voltage is found out. Then, while the optimal developing bias voltage is applied, the toner patterns 201 for the halftone density control are formed in accordance with image data of a multiple of different tone levels. The optical sensors SE1 detect the densities of the toner patterns 201, and the developing bias voltage is adjusted to achieve a desired halftone density.

In the color registration control, the process units form toner patterns of the respective colors, and the optical sensors SE1 detect the positions of the toner patterns. Then, misalignment of colors is detected based on the detection results, and if necessary, corrections are made to achieve color registration. This color registration control is described with reference to FIG. 17. FIG. 17 schematically shows an example of formation of toner patterns on the intermediate transfer belt 21 for the color registration control. The toner patterns 301 and 302 are to detect color misalignment in the sub-scanning direction. The toner patterns 303 and 304 are to detect the color misalignment in the main-scanning direction and are formed to slant at an angle of 45 degrees. The toner patterns 301, 302, 303 and 304 are detected at times tsf1 to tsf4, tmf1 to tmf4, tsr1 to tsr4 and tmr1 to tmr4, respectively.

The speed of the transfer belt 21 is supposed to be v (mm/s). With respect to the toner patterns 301 and 302 for detection of the color misalignment in the sub-scanning direction, the theoretical distances from the black toner patterns 301K and 302K to the toner patterns of the other colors 301C, 302C, 301M, 302M, 301Y and 302Y are supposed to be dcC (mm), dcM (mm), and dcY (mm). The misalignment δ es of the respective colors from black (K) in the sub-scanning direction are calculated as follows.

$$\delta esC = v \times \{(tsf2 - tsf1) + (tsr2 - tsr1)\}/2 - dcC$$

$$\delta esM = v \times \{(tsf3 - tsf1) + (tsr3 - tsr1)\}/2 - dcM$$

$$\delta esY = v \times \{(tsf4 - tsf1) + (tsr4 - tsr1)\}/2 - dcY$$

From the calculation results, the directions and the amounts of misalignment of the colors C, M and Y in the sub-scanning direction from black K are found out. Then, by adjusting the writing start position of the first line of each of the colors C, M and Y based on the calculation results, the color misalignment in the sub-scanning direction can be corrected.

With respect to the respective colors K, C, M and Y and with respect to the left side and the right side, the actual measured distances between the toner patterns 301 and 302 for detection of the color misalignment in the sub-scanning direction and the toner patterns 303 and 304 for detection of the color misalignment in the main-scanning direction are as follows.

$$dmfK=V\times(tmf1-tsf1)$$

$$dmfC=V\times(tmf2-tsf2)$$

$$dmfM=V\times(tmf3-tsf3)$$

$$dmfY=V\times(tmf4-tsf4)$$

$$dmrK=V\times(tmr1-tsr1)$$

$$dmrC=V\times(tmr2-tsr2)$$

$$dmrM=V\times(tmr3-tsr3)$$

$$dmrY=V\times(tmr4-tsr4)$$

Then, with respect to the left side and the right side, the misalignment δ emf and δ emr of the colors C, M and Y from black K in the main-scanning direction are calculated as follows.

$$\delta emfC=dmfC-dmfK$$

$$\delta emfM=dmfM-dmfK$$

$$\delta emfY=dmfY-dmfK$$

$$\delta emrC=dmrC-dmrK$$

$$\delta emrM=dmrM-dmrK$$

$$\delta emrY=dmrY-dmrK$$

With respect to each of the colors C, M and Y, from the sign (positive or negative) of the value, the direction of the misalignment can be judged, and the writing start position in the main-scanning direction is adjusted based on the value δ emf, and further, the length of main scanning is adjusted based on a value δ emr−δ emf. When there are differences among the colors in the length of main scanning, the image clock frequency is changed, and the writing start position in the main-scanning direction of each color is adjusted based on the change in the image clock frequency, as well as the value δ emf.

Each of the toner patterns 101 to 104 for the toner adherence control, as shown in FIG. 15, has a length in the sub-scanning direction that is equal to the length of one rotation of a developing roller. As shown by FIG. 18, density unevenness is seen periodically with rotations of the developing roller, and this is due to distortion or eccentricity of the developing roller. Therefore, it is necessary to detect toner densities in an area corresponding to one rotation of the developing roller with an optical sensor. Then, the detected values are averaged, and the average of the detected values is used for the control. Also, if necessary, corrections are made so as to suppress the density unevenness.

The above-described image stabilization control, however, has the following problems. The color registration control and the halftone density control are carried out after the toner adherence control is carried out, and therefore, it takes much time for the image stabilization control. The toner patterns for the toner adherence control are solid patterns that have even densities in the sub-scanning direction, and a large amount of toner is consumed even for parts that are not to be detected by the optical sensors.

In order to solve the problems, Japanese Patent Laid-Open Publication No. 2002-14505 suggests that color registration control and halftone density control be carried out at the same time. More specifically, three optical sensors for detecting toner patterns formed on an intermediate transfer belt are arranged in the main-scanning direction. Two optical sensors disposed on both sides detect toner patterns for the color registration control, and the optical sensor disposed in the center detects toner patterns for the halftone density control. Likewise, Japanese Patent Laid-Open Publication No. 2005-321569 suggests that color registration control and toner adherence control be carried out at the same time by using three optical sensors. More specifically, two optical sensors disposed on both sides detect toner patterns for the color registration control, and the optical sensor disposed in the center detects toner patterns for the toner adherence control.

In either of the methods, the time for the image stabilization control can be shortened, but the cost is raised because three optical sensors are necessary. Further, each of the toner patterns for toner adherence control must have a length at least corresponding to the length of one rotation of a developing roller, and the toner consumption cannot be reduced.

SUMMARY OF THE INVENTION

According to a first aspect of the present invention, an image forming apparatus comprises: an image bearing member that moves at a specified speed; a toner pattern forming section for forming toner patterns of a specified type on the image bearing member under specified image forming conditions; a toner pattern detection member for detecting the toner patterns formed on the image bearing member; a toner amount varying section for varying a target amount of toner to adhere to the toner patterns; and a control section that calculates a toner adherence amount and a toner adherence position from detection results outputted from the toner pattern detection member and that performs image stabilization control to adjust the image forming conditions based on the calculation results, wherein in the image stabilization control, the control section uses detection results of the same toner patterns both to calculate the toner adherence amount and to calculate the toner adherence position.

According to a second aspect of the present invention, an image forming apparatus comprises: an image bearing member that moves at a specified speed; a toner pattern forming section for forming toner patterns of a specified type on the image bearing member under specified image forming conditions; a toner pattern detection member for detecting the toner patterns formed on the image bearing member; a toner amount varying section for varying a target amount of toner to adhere to the toner patterns; and a control section that calculates a toner adherence amount from detection results outputted from the toner pattern detection member and that performs image stabilization control to adjust the image forming conditions based on the calculation result, wherein for the image stabilization control, the control section controls the toner pattern forming section to form stripe toner patterns, each of which comprises lines extending in a direction perpendicular to a moving direction of the image bearing member.

According to a third aspect of the present invention, an image stabilization method performed in an image forming apparatus comprises: forming toner patterns of a specified type on an image bearing member under specified image forming conditions while the image bearing member is moving at a specified speed; detecting the toner patterns formed on the image bearing member; varying a target amount of toner to adhere to the toner patterns; and calculating a toner adherence amount and a toner adherence position from detection results of the toner patterns and adjusting the image forming conditions based on the calculation results, wherein in order to adjust the image forming conditions, detection results of the same toner patterns are used both to calculate the toner adherence amount and to calculate the toner adherence position.

According to a fourth aspect of the present invention, an image stabilization method performed in an image forming apparatus comprises: forming stripe toner patterns on an image bearing member under specified image forming conditions while the image bearing member is moving at a specified speed such that each of the stripe toner patterns comprises lines extending in a direction perpendicular to a moving direction of the image bearing member; detecting the toner patterns formed on the image bearing member; varying a target amount of toner to adhere to the toner patterns; and calculating a toner adherence amount from detection results of the toner patterns and adjusting the image forming conditions based on the calculation result.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An image forming apparatus according to an embodiment of the present invention is hereinafter described with reference to the drawings.

General Structure of the Image Forming Apparatus; See FIG. 1

Figure 1:
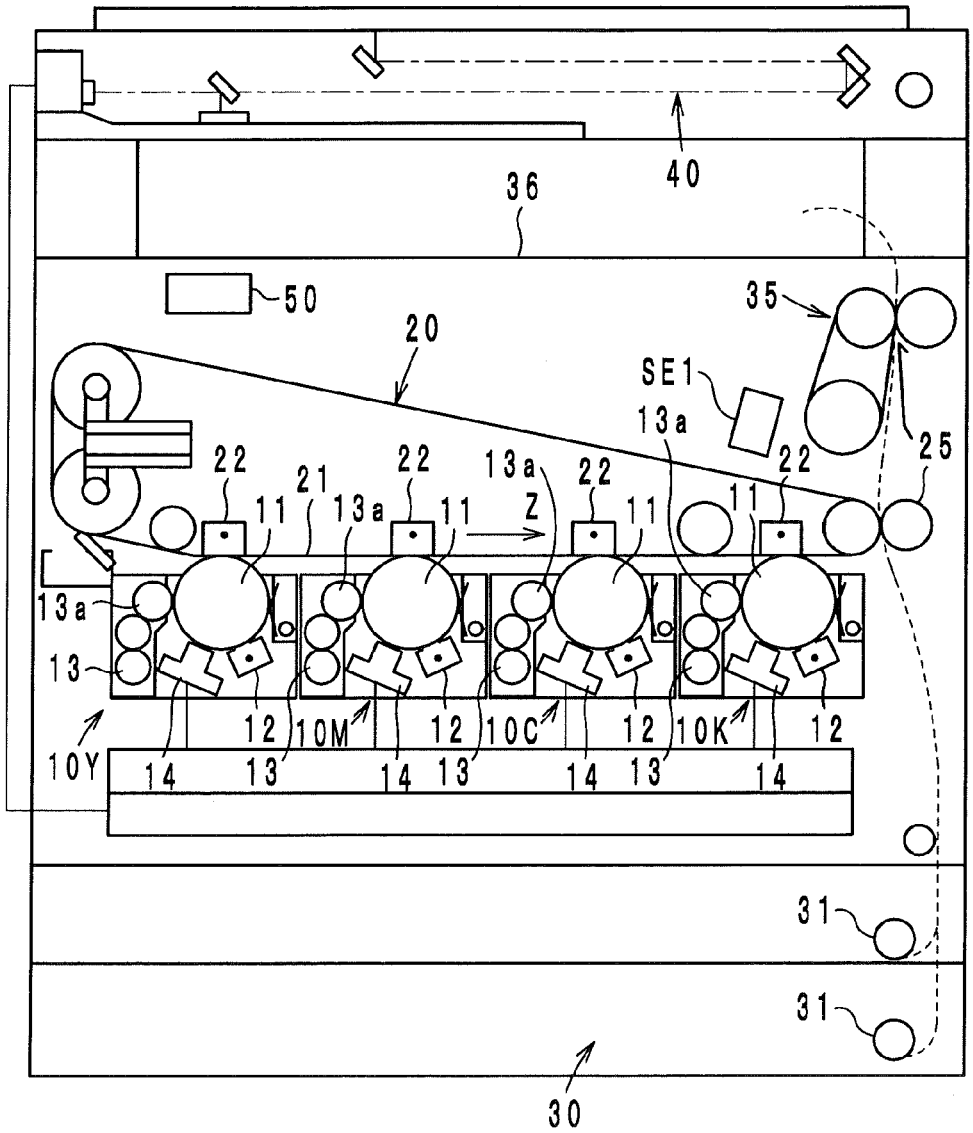
FIG. 1 is a skeleton framework of an image forming apparatus according to an embodiment of the present invention.

An image forming apparatus according to an embodiment of the present invention is, as shown by FIG. 1, a tandem type electrophotographic printer. The printer generally comprises process units 10 (10Y, 10M, 10C and 10K) for forming toner images of yellow (Y), magenta (M), cyan (C) and black (K), respectively, an intermediate transfer unit 20, a sheet feed unit 30, a fixing unit 35 and an image reading unit 40.

Each of the process units 10 comprises a photosensitive drum 11, a charger 12, a developing device 13 and an exposure device 14. An electrostatic latent image is formed on each of the photosensitive drums 11 by laser radiation from the exposure device 14, and the electrostatic latent image is developed into a toner image by the developing device 13. Image data are transmitted from the image reading unit 40 or a computer to a control section 50.

The intermediate transfer unit 20 has an intermediate transfer belt 21 that is an endless belt driven to rotate in a direction "Z". Transfer chargers 22 are disposed to face to the respective photosensitive drums 11, and toner images formed on the photosensitive drums 11 are transferred onto the intermediate transfer belt 21 by electric fields generated by the transfer chargers 22 (first transfer), such that the toner images are combined into a composite full-color image on the intermediate transfer belt 21. Such an electrophotographic image forming process is well known, and a detailed description thereof is omitted.

In a lower part of the body of the image forming apparatus, a sheet feed unit 30 for feeding recording sheets one by one is disposed. Each recording sheet is fed from a feed-out roller 31 to a nip portion between the intermediate transfer belt 21 and a second transfer roller 25, where the composite full-color image is transferred onto the recording sheet (second transfer). Thereafter, the recording sheet is fed to the fixing unit 35, where toner is fixed on the sheet by heat, and the sheet is ejected onto a tray 36 disposed on an upper surface of the apparatus body.

Sensors SE1 for detecting toner patterns for image stabilization control are disposed downstream from the process unit 10K to face to the surface of the intermediate transfer belt 21. The sensors SE1 are optical reflection type sensors. Alternatively, the optical sensors SE1 may be disposed in positions to detect toner patterns formed on the respective photosensitive drums 11 or may be disposed in positions to detect toner patterns formed on a recording sheet after the second transfer.

Control Section; See FIG. 2

Figure 2:
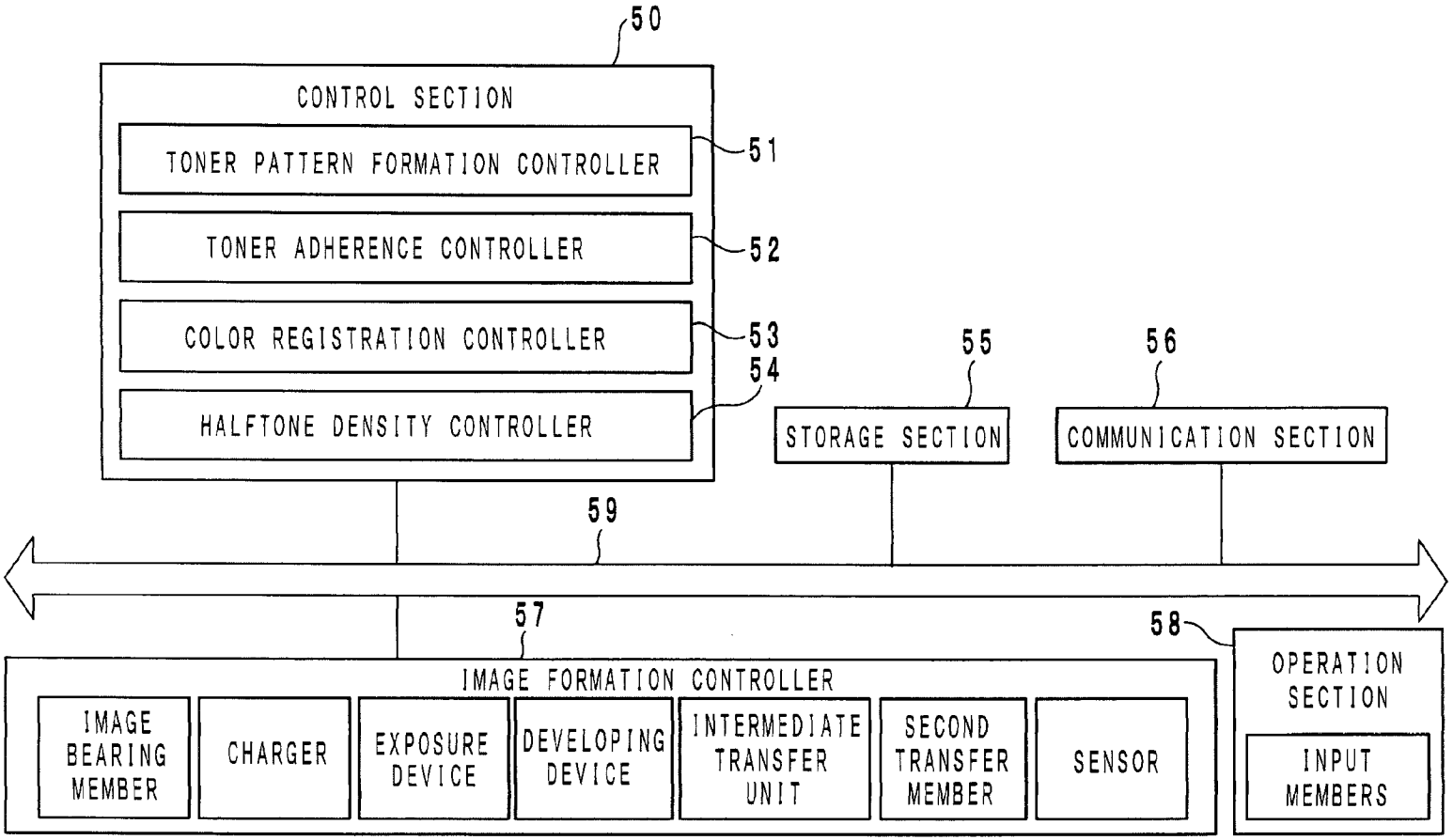
FIG. 2 is a block diagram of a control section of the image forming apparatus.

The control section 50 has a CPU, a ROM stored with control programs, a work memory, etc. As shown by FIG. 2, the control section 50 comprises a toner pattern formation controller 51, a toner adherence controller 52, a color registration controller 53 and a halftone density controller 54. The control section 50 is connected to a storage section 55, a communication section 56, an image formation controller 57 and an operation section 58 via a system bus 59, so that the control section 50 controls these sections 55, 56, 57 and 58 in block. For example, the control section 50 receives various kinds of data for settings from the operation section 58 or a host computer, checks and transforms the data, and stores the transformed data in the data storage section 55. Further, the control section 50 performs image stabilization control as will be described below.

Optical Sensor; See FIG. 3

Figure 3A:
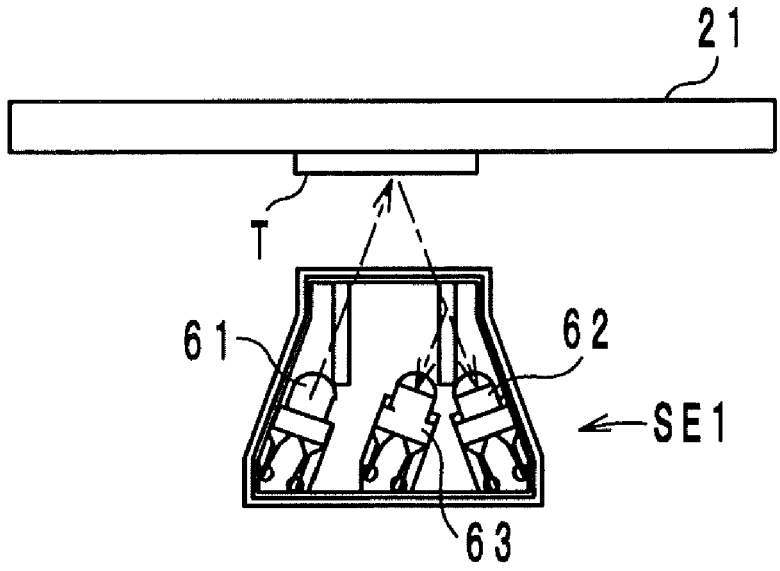
FIGS. 3*a* and 3*b* are sectional views of exemplary optical sensors for detecting toner patterns, FIG. 3*a* showing a first exemplary optical sensor and FIG. 3*b* showing a second exemplary optical sensor.
Figure 3B:
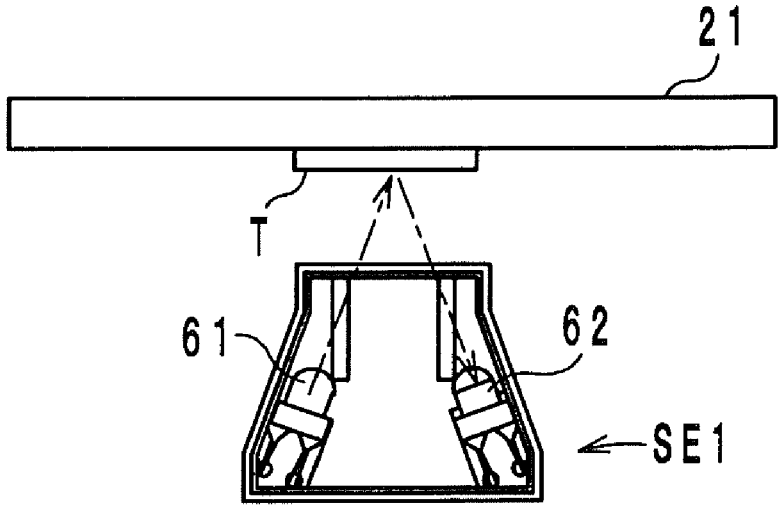

A sensor shown by FIG. 3*a* and a sensor shown by FIG. 3*b* are suited to be used as the optical sensors SE1. The sensor shown by FIG. 3*a* comprises a light emitting diode (LED) 61 for emitting light to a toner pattern T, a photodiode (PD) 62 for receiving light of specular reflection from the toner pattern T, and a photodiode (PD) 63 for receiving light of diffuse reflection from the toner pattern T. The second sensor shown by FIG. 3*b* comprises a light emitting diode (LED) 61, and a photodiode (PD) 62 for receiving light of specular reflection from the toner pattern T.

Image Stabilization Control; See FIGS. 4-14

Image stabilization control is to control factors of image formation so as to achieve a desired high picture quality. The image stabilization control is automatically performed at predetermined times, and moreover, the image stabilization control can be performed by order of a user or a serviceman. Generally, the image stabilization control is performed at times when image formation is not performed, such as on completion of a print job. Also, the image stabilization control is performed on completion of an exchange of consumable goods.

Figure 4:
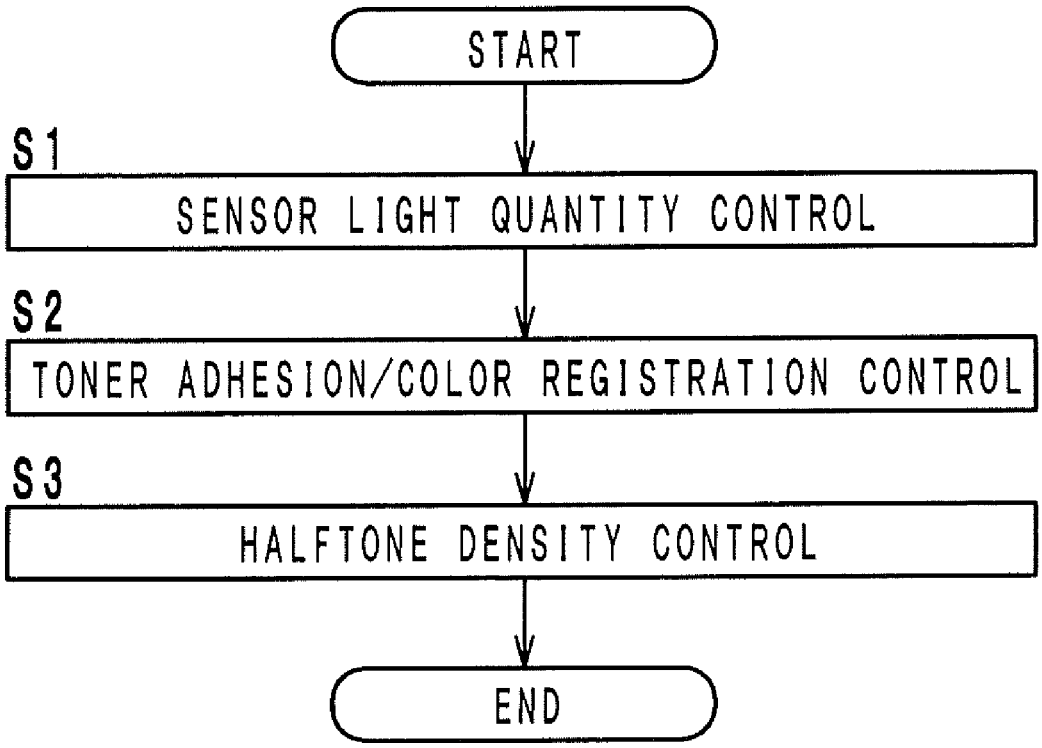
FIG. 4 is a flowchart showing a procedure for carrying out image stabilization control.

It is predetermined, depending on the characteristics of the image forming apparatus, what kinds of image stabilization control is to be actually carried out. However, the image stabilization control generally includes sensor light quantity control, toner adherence control, color registration control and halftone density control. According to the circumstances of the image forming apparatus, only one kind of image stabilization control is carried out, or two or more kinds of image stabilization control are carried out at the same time. When two or more kinds of control are carried out at the same time, as shown by FIG. 4, the sensor light quantity control (step S1), the toner adherence control/the color registration control (step S2) and the halftone density control (step S3) are carried out in this sequence.

The sensor light quantity control is to obtain a target output value of the sensors SE1 when the sensors SE1 detect the surface of the intermediate transfer belt 21 (without a toner image formed thereon). The toner adherence control is to obtain a solid image with a black/white ratio of 100%. The color registration control is to achieve color registration by correcting the positions of images of the respective colors, Y, M, C and K in the main-scanning direction and in the sub-scanning direction. The halftone density control is to achieve desired gradation characteristics.

These kinds of image stabilization control are feedback control. After the state of image formation is actually examined, the factors of image formation are adjusted. In order to recognize the state of image formation, toner patterns are formed on the intermediate transfer belt 21 under specified image forming conditions. In this embodiment, the same toner patterns are used for the toner adherence control and for the color registration control. The details thereof will be described later.

Based on the detection results of the toner patterns outputted from the optical sensors SE1, the factors are adjusted and set. In this embodiment, the factor to be adjusted based on the detection result with respect to the toner adherence is the developing bias voltage. However, the factor to be adjusted may be other parameters that have influences on the toner adherence, such as the amount of exposure of the photosensitive drum 11, the ratio of the circumferential speed of the developing roller to the circumferential speed of the photosensitive drum 11, etc. The factor to be adjusted based on the detection result with respect to the color registration is, generally, the writing start timing of the exposure device 14 on the photosensitive drum 11. For the halftone density control, generally, patterns treated with dithering or patterns treated with an error diffusion method are used, and the factor to be adjusted based on the detection result with respect to the halftone density is, generally, data used for the dithering or the error diffusion method.

First Example of Toner Adherence Control and Color Registration Control

Figure 5:
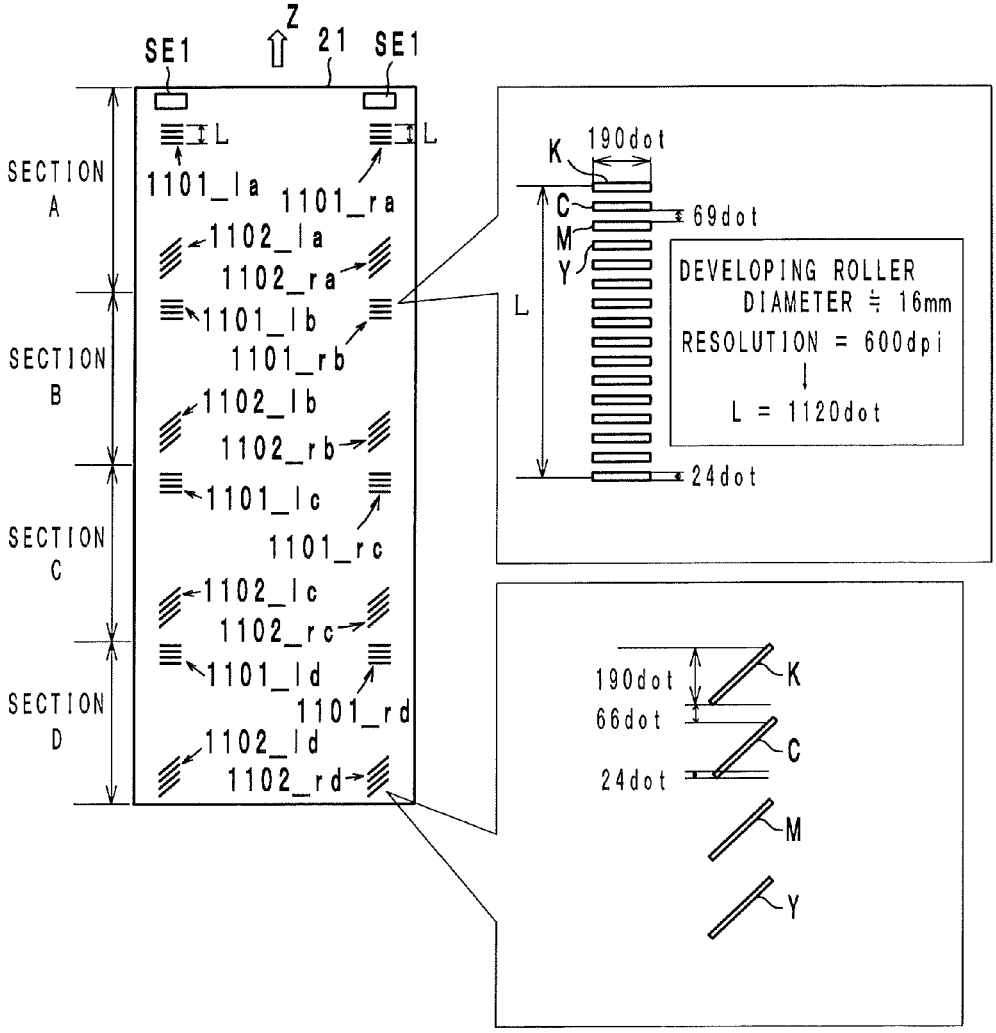
FIG. 5 is a plan view schematically showing a first exemplary formation of toner patterns.

First, toner patterns used for the first example of toner adherence control and color registration control are described. In the first example, as shown by FIG. 5, toner patterns are formed at both sides of the intermediate transfer belt 21, and two optical sensors SE1 are disposed in positions to detect the toner patterns aligned at the both sides. Eight toner patterns 1101_*la* to 1101_*ld* and 1101_*ra* to 1101_*rd* are formed for detection of color misalignment in the sub-scanning direction. Specifically, four toner patterns 1101_*la* to 1101_*ld* are formed at the left side, and four toner patterns 1101_*ra* to 1101_*rd* are formed at the right side. Further, eight toner patterns 1102_*la* to 1102_*ld* and 1102_*ra* to 1102_*rd* are formed for detection of color misalignment in the main-scanning direction. Specifically, four toner patterns 1102_*la* to 1102_*ld* are formed at the left side, and four toner patterns 1102_*ra* to 1102_*rd* are formed at the right side. These toner patterns are scattered on the intermediate transfer belt 21 evenly in an area corresponding to one rotation of the intermediate transfer belt 21. In FIG. 5, the total length of the sections A to D is the length of one rotation of the intermediate transfer belt 21.

The toner patterns 1101 for detection of color misalignment in the sub-scanning direction are stripe patterns, each of which comprises lines extending in a direction perpendicular to the moving direction Z of the intermediate transfer belt 21 (the sub-scanning direction Z). In other words, the lines are formed to extend in the main-scanning direction, such that with the motion of the intermediate transfer belt 21, the optical sensors SE1 detect each of the toner patterns 1101 by crossing the lines. Each of the toner patterns 1101 comprises 16 lines, and more specifically, a set of four lines, namely, a line of the color K, a line of the color C, a line of the color M and a line of the color Y is formed repeatedly four times. Each of the lines has a width (dimension in the sub-scanning direction) of 24 dots and has a length (dimension in the main-scanning direction) of 190 dots. Each of the toner patterns 1101 has a length L (from the first line to the last line) equal to the length of one rotation of a developing roller 13*a* (see FIG. 1).

The toner patterns 1102 for detection of color misalignment in the main-scanning direction are stripe patterns, each of which comprises lines slanting from the sub-scanning direction at an angle of 45 degrees. Each of the toner patterns 1102 comprises four lines, that is, a line of the color K, a line of the color C, a line of the color M and a line of the color Y formed in this order in the moving direction Z of the intermediate transfer belt 21. Each of the lines has a width of 24 dots.

Figure 7:
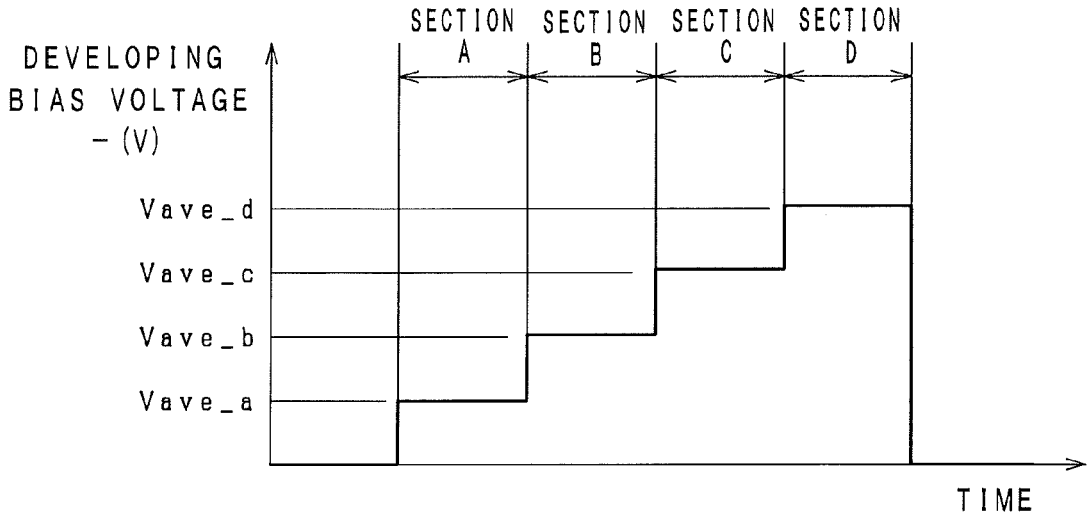
FIG. 7 is a graph showing changes of a developing bias voltage in forming the toner patterns.

Now, referring to FIG. 7, the developing bias voltage for formation of the toner patterns is described. For the sections A, B, C and D divided to traverse the sub-scanning direction, the developing bias voltage is raised to Vave_a, Vave_b, Vave_c and Vave_d intermittently. These four levels of the voltage are determined on the basis of the state of the image forming apparatus (the initial developing bias voltage, the humidity and other environmental conditions, the total operation hours, etc.).

Figure 8:
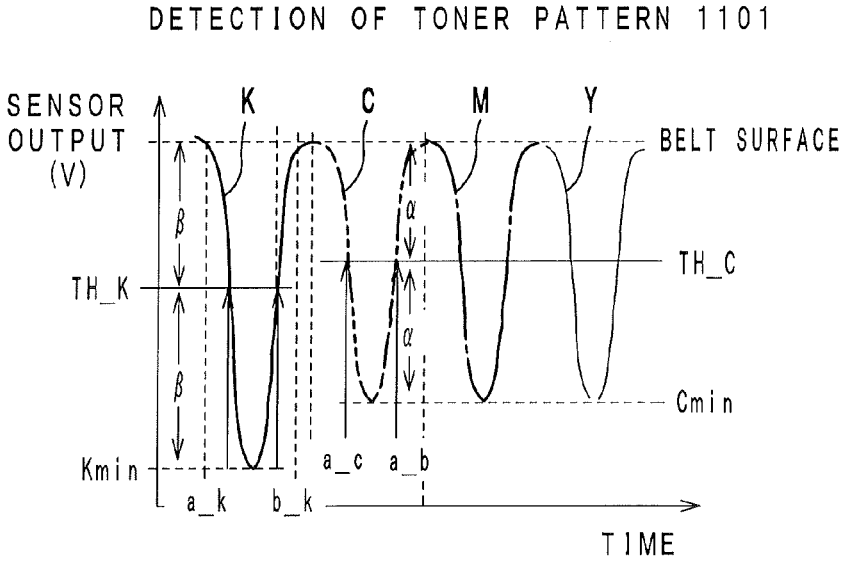
FIG. 8 is a graph showing output waves from the optical sensor.

Next, how to use the outputs of the optical sensors SE1 is described. The outputs of the optical sensors SE1 were adjusted beforehand in the sensor light quantity control, such that the sensors SE1 output a target value when the sensors SE1 detect the surface of the intermediate transfer belt 21. FIG. 8 shows an output from one of the optical sensors SE1 while the sensor SE1 is detecting a set of lines in a toner pattern. In detecting a toner pattern, the optical sensor SE1 detects a line of K, a line of C, a line of M, a line of Y, . . . sequentially. In the graph of FIG. 8, the waves from the left along the time axis (x axis) indicate detection of a line of K, detection of a line of C, detection of a line of M and detection of a line of Y. For the toner adherence control of a color, the minimum output values from the optical sensors SE1 during detection of lines of the color are used. For example, the minimum output value Kmin is used for the toner adherence control of K, and the minimum output value Cmin is used for the toner adherence control of C.

For the color registration control, the times when the centers of lines of the toner patterns pass the detection points of the sensors SE1 are used. As shown in FIG. 8, while the sensor SE1 detects a line of a stripe toner pattern, the sensor SE1 outputs a wave including a falling portion that falls from the output value indicating the surface of the intermediate transfer belt 21 (maximum value) to a minimum value indicating the thickest point of the line and a rising portion that rises from the minimum value to the output value indicating the surface of the intermediate transfer belt 21 again. In the falling portion and the rising portion of the wave, the times when the optical sensor SE1 outputs a mid value between the maximum value and the minimum value are specified. For example, while the sensor SE1 detects a line of the color K, the sensor SE1 outputs a mid value at the times a_k and b_k, and while the sensor SE1 detects a line of the color C, the sensor SE1 outputs a mid value at the times a_c and a_b. By using the times when the optical sensor SE1 outputs the mid value, the time when the center of a line passes the detection point of the optical sensor SE1 is figured out. For example, the time when the center of a line of K is detected by the optical sensor SE1 is calculated by (a_k+b_k)/2, and the time when the center of a line of C is detected by the optical sensor SE1 is calculated by (a_c+a_b)/2.

Next, a process of calculating optimal developing bias voltages for the four colors is described. In the toner adherence control, developing bias voltages to achieve predetermined target toner adherence amounts for the four respective colors are calculated. For this purpose, the detection results of the toner patterns 1101 and 1102 outputted from the optical sensors SE1 are treated in the following way. In each of the sections A, B, C and D, that is, on each of the four bias voltage levels (see FIG. 7), there are ten lines each of the same color, and with respect to a color, ten minimum output values are obtained. The ten minimum output values are averaged, and from the average minimum output value for the color, the amount of toner adhering to a solid image of the color is calculated. For the calculation of the toner adherence amount, a calculating formula or a look-up table stored in the control section 50 is used. In this way, with respect to each of the four colors, four values can be obtained as the amounts of toner adhering to the solid images of the color formed under different conditions of the four different bias voltage levels.

Figure 11:
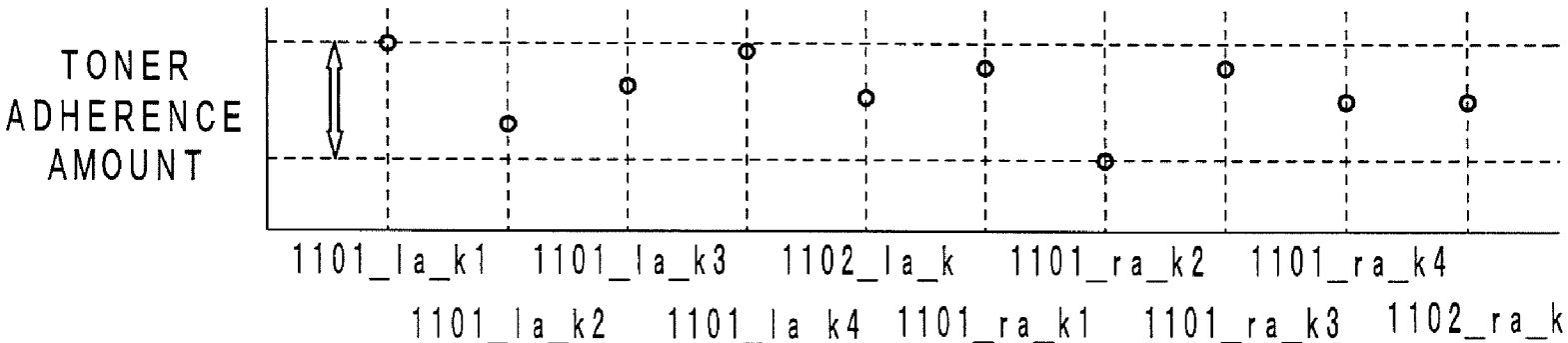
FIG. 11 is a graph showing the amounts of toner adhering to the lines of a color in a pair of toner patterns of the first exemplary formation of toner patterns, the amounts calculated from output values of the optical sensors.

Meanwhile, from the ten minimum output values for a color obtained on each bias voltage level, the amounts of toner adhering to the respective lines of the same color formed under the same condition of the same developing bias voltage are calculated by using the calculating formula or the look-up table. FIG. 11 shows the toner adherence amounts of K calculated from the minimum output values of the optical sensors SE1 while the sensors SE1 detect the toner patterns 1101_*la*, 1101_*ra*, 1102_*la* and 1102_*ra* (see FIG. 5) formed under the same condition of the same bias voltage level. In the case of FIG. 11, the maximum toner adherence amount is marked by the line 1101_*la*_*k*1, and the minimum toner adherence amount is marked by the line 1101_*ra*_*k*2.

From the maximum toner adherence amount and the minimum toner adherence amount on the same bias voltage level, periodical density unevenness due to distortion/eccentricity of the developing roller 13*a* can be recognized. The difference between the maximum toner adherence amount and the minimum toner adherence amount (the degree of density unevenness) is within a tolerable range, there is no problem. However, if the degree of density unevenness is beyond the tolerable range, the image forming apparatus shall be forcibly stopped, and a trouble warning shall be raised so as to warn the user to take an action to return the apparatus into a normal state.

Figure 9:
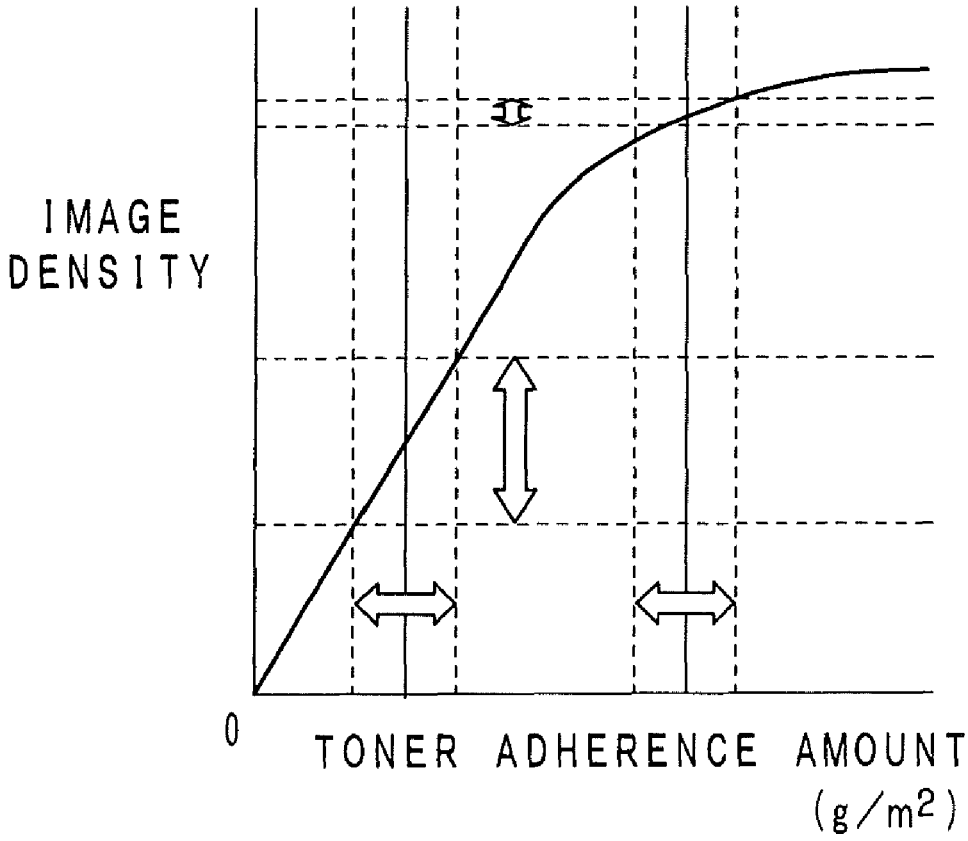
FIG. 9 is a graph showing the relationship between the toner adherence amount and the image density (output values of the optical sensor)

In the case wherein the degree of density unevenness is beyond the tolerable range, alternatively, the target toner adherence amount may be heightened. As shown by FIG. 9, it is likely that the sensitivity of the optical sensors SE1 becomes lower as the toner adherence amount increases. Accordingly, by heightening the target toner adherence amount, the density unevenness in a solid pattern can be suppressed within the tolerable range.

Figure 10A:
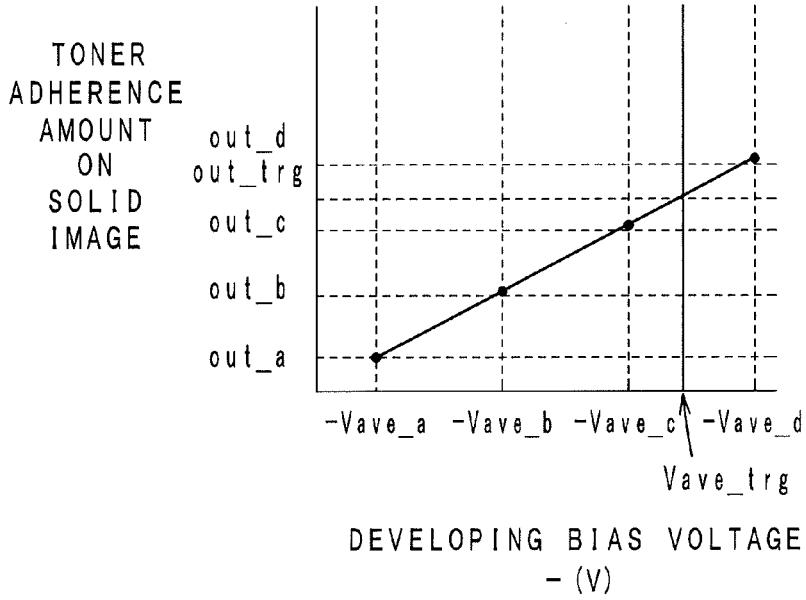
FIGS. 10*a* and 10*b* are graphs showing a method for calculating a developing bias voltage for achieving a target amount of adhering toner.
Figure 10B:
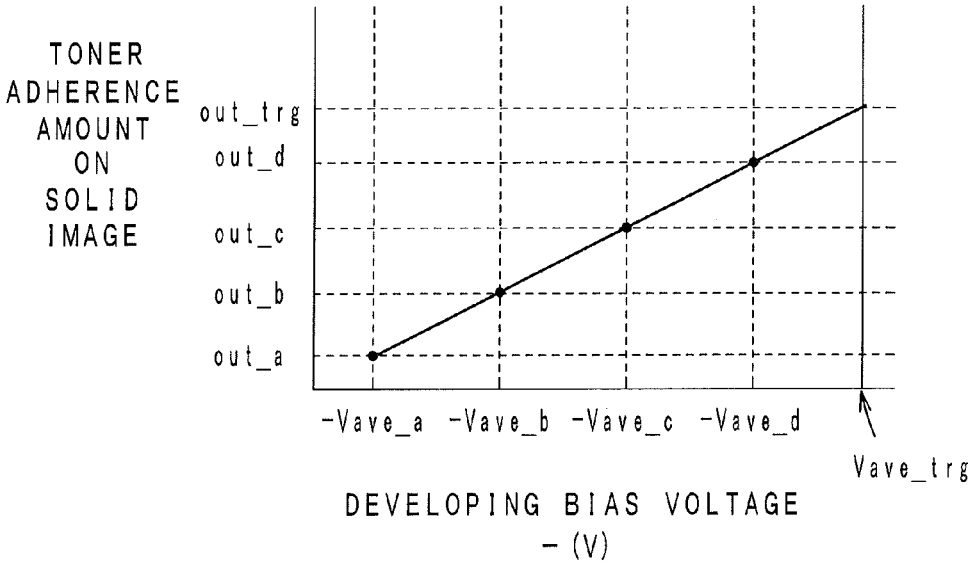

Next, referring to FIGS. 10*a* and 10*b*, a process of calculating an optimal developing bias voltage for each color from the four toner adherence amounts on the four developing bias voltage levels is described. FIGS. 10*a* and 10*b* show the relationship between the developing bias voltage Vave and the toner adherence amount with respect to formation of black (K) images. The voltages Vave_a to Vave_d are the developing bias voltages applied in the sections A to D, respectively, in the black (K) image process unit 10K. FIG. 10*a* shows a case wherein the optimal bias voltage (Vave_trg) for achieving the target toner adherence amount is within the range from Vave_a to Vave_d. FIG. 10*b* shows a case wherein the optimal bias voltage (Vave_trg) for achieving the target toner adherence amount is out of the range from Vave_a to Vave_d.

In the case of FIG. 10*a*, by performing straight-line approximation and interpolation within a range from Vave_c and Vave_d, the optimal developing bias voltage (Vave_trg) for achieving the target toner adherence amount is figured out. In the case of FIG. 10*b*, by performing straight-line approximation and interpolation beyond the level Vave_d, the optimal developing bias voltage (Vave_trg) for achieving the target toner adherence amount is figured out. The straight-line approximation is carried out by using a method of least squares.

The stripe toner patterns are also used for the color registration control. Now, a process of calculating the writing start times in the main-scanning direction and a process of calculating the writing start times in the sub-scanning direction for the respective colors are described. From the positions of the centers of the respective lines in the toner patterns calculated in the above-described way, the writing start times in the main-scanning direction and in the sub-scanning direction are calculated.

The writing start times in the sub-scanning direction of the respective colors are calculated by using detection results of the eight toner patterns 1101. First, in each of the eight toner patterns 1101, the amount of misalignment of the center of C from the center of K in the sub-scanning direction, the amount of misalignment of the center of M from the center of K in the sub-scanning direction and the amount of misalignment of the center of Y from the center of K in the sub-scanning direction are calculated. Accordingly, by detecting the eight toner patterns 1101, with respect to each of the colors C, M and Y, eight values are obtained as the amounts of misalignment from the color K in the sub-scanning direction. Next, by averaging the eight values, the average amount of misalignment of each of the colors C, M and Y from the color K in the sub-scanning direction is calculated. Then, with respect to each of the colors C, M and Y, on the basis of the average amount of misalignment, the writing start time in the sub-scanning direction is determined.

Now, the calculation for the amount of misalignment in the sub-scanning direction of a color from black K in one toner pattern 1101 is described, exemplifying the misalignment of the color C from the color K. As shown in the magnified view of the toner pattern 1101_*rb* of FIG. 5, each of the toner patterns 1101 has four sets of four lines of the colors KCMY. Specifically, lines of the four colors K, C, M and Y are arranged repeatedly four times in the belt moving direction Z. The first set of lines K, C, M and Y is provided with a reference number 1, and the second set is provided with a reference number 2. The third set is provided with a reference number 3, and the fourth set is provided with a reference number 4. The center of the line C1 is compared with the center of the line K1, and the center of the line C2 is compared with the center of the line K2. The center of the line C3 is compared with the center of the line K3, and the center of the line C4 is compared with the center of the line K4.

In this way, a total of four values can be obtained as the amount of misalignment of the color C from the color K in the toner pattern. These four values are averaged, and the average is used as the amount of misalignment of C from K in the toner pattern. In the same way, in one toner pattern, the amount of misalignment of M from K in the sub-scanning direction and the amount of misalignment of Y from K in the sub-scanning direction are calculated.

The writing start times in the main-scanning direction of the respective colors are calculated by using detection results of both the eight toner patterns 1101 and the eight toner patterns 1102. Specifically, in a pair of toner patterns 1101 and 1102 (e.g., 1101_*la* and 1102_*la*), the amount of misalignment of the center of C from the center of K in the main-scanning direction, the amount of misalignment of the center of M from the center of K in the main-scanning direction and the amount of misalignment of the center of Y from the center of K in the main-scanning direction are calculated. By performing this calculation in all the eight pairs of toner patterns 1101 and 1102, eight values are obtained as the amounts of misalignment of each of the colors C, M and Y from the color K in the main-scanning direction. Next, by averaging the eight values, the average amount of misalignment of each of the colors C, M and Y from the color K in the main-scanning direction is calculated. Then, for each of the colors, on the basis of the average amount of misalignment, the writing start time in the main-scanning direction is determined.

Now, the calculation for the amount of misalignment in the main-scanning direction of a color from black K in a pair of toner patterns 1101 and 1102 is described. As shown by the magnified view of the toner pattern 1102_*rd* of FIG. 5, each of the toner patterns 1102 comprises lines of the colors K, C, M and Y slanting from the belt moving direction (sub-scanning direction) Z at an angle of 45 degrees. Therefore, by measuring the distance (time difference) between a line under examination and a reference line, the direction and the amount of misalignment of the line under examination from the reference line can be figured out. In examining a line of a color, the line of the same color formed immediately before the line is used as the reference line. For example, when a line of a color in the toner pattern 1102_*rd* is examined, the line of the same color in the fourth set of lines in the toner pattern 1101_*rd* is used as the reference line.

This is described in more details by using the numbers specifying the respective lines in each of the toner patterns in the same way as described in connection with the calculation of the writing start times in the sub-scanning direction. For example, when the line 1102_*rd*_K is examined, the line 1101_*rd*_K4 is used as the reference line, and when the line 1102_*rd*_C is examined, the line 1101_*rd*_C4 is used as the reference line. When the line 1102_*rd*_M is examined, the line 1101_*rd*_M4 is used as the reference line, and when the line 1102_*rd*_Y is examined, the line 1101_*rd*_Y4 is used as the reference line. If the distance between the line under examination and the reference line is longer than a target value, the line under examination is judged to be misaligned in the right in FIG. 5. If the distance between the line under examination and the reference line is shorter than the target value, the line under examination is judged to be misaligned in the left in FIG. 5. In this way, in a pair of toner patterns 1101 and 1102, with respect to each of the four colors Y, M, C and K, the amount of misalignment in the main-scanning direction between lines of the same color can be calculated. Thereafter, the amount of misalignment in the main-scanning direction between lines of the color C, the amount of misalignment in the main-scanning direction between lines of the color M and the amount of misalignment in the main-scanning direction between lines of the color Y are compared with the amount of misalignment in the main-scanning direction between lines of the color K. In this way, in a pair of toner patterns 1201 and 1202, the amounts of misalignment of the three colors C, M and Y from the color K in the main-scanning direction are obtained.

The writing start points of the respective first lines of the colors C, M and Y are adjusted on the basis of the amounts of misalignment of the colors C, M and Y from the color K in the sub-scanning direction calculated in the above-described method, thereby achieving color registration in the sub-scanning direction. In the same way, the writing start points of the colors C, M and Y are adjusted on the basis of the amounts of misalignment of the colors C, M and Y from the color K in the main-scanning direction calculated in the above-described method, thereby achieving color registration in the main-scanning direction. Further, when there are errors in the length of main scanning, the clock frequency is changed to correct the length of main scanning, and the writing start points of the colors in the main-scanning direction are adjusted also on the basis of the change of the clock frequency.

Second Example of Toner Adherence Control and Color Registration Control

Figure 6:
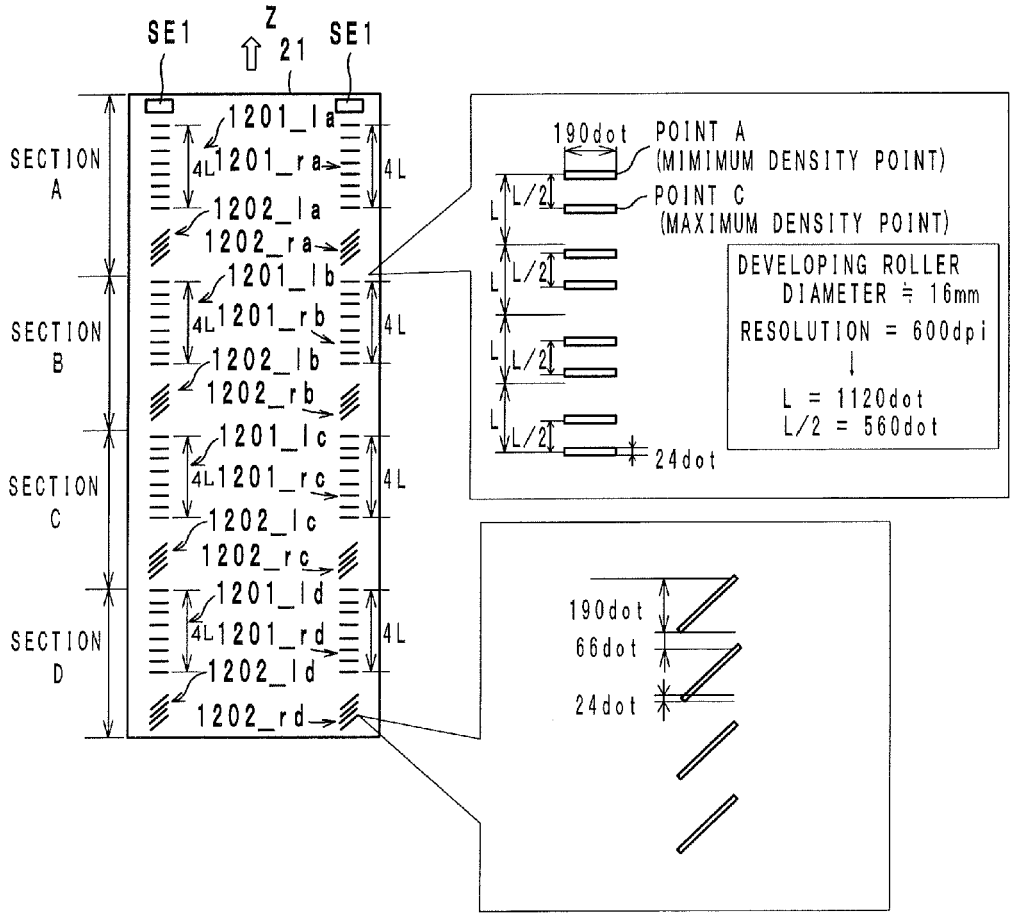
FIG. 6 is a plan view schematically showing a second exemplary formation of toner patterns.

First, toner patterns used for the second example of toner adherence control and color registration control are described. In the second example, as shown by FIG. 6, toner patterns are formed at both sides of the intermediate transfer belt 21, and two optical sensors SE1 are disposed in such positions to detect the toner patterns aligned at the both sides. Eight toner patterns 1201_*la* to 1201_*ld* and 1201_*ra* to 1201_*rd* are formed for detection of color misalignment in the sub-scanning direction, and eight toner patterns 1202_*la* to 1202_*ld* and 1202_*ra* to 1202_*rd* are formed for detection of color misalignment in the main-scanning direction. These toner patterns are scattered on the intermediate transfer belt 21 evenly in an area corresponding to one rotation of the intermediate transfer belt 21. In FIG. 6, the total length of the sections A to D is the length of one rotation of the intermediate transfer belt 21.

The toner patterns for detection of color misalignment in the sub-scanning direction are stripe patterns, each of which comprises lines extending in a direction perpendicular to the moving direction Z of the intermediate transfer belt 21 (the sub-scanning direction Z). In other words, the lines are formed to extend in the main-scanning direction, such that with the motion of the intermediate transfer belt 21, the optical sensors SE1 detect each of the toner patterns 1201 by crossing the lines. Each of the toner patterns 1201 comprises eight lines, and more specifically, two lines of the color K, two lines of the color C, two lines of the color M and two lines of the color Y are arranged in this order in the moving direction Z of the intermediate transfer belt 21. Each of the lines has a width (dimension in the sub-scanning direction) of 24 dots and has a length (dimension in the main-scanning direction) of 190 dots. In each of the toner patterns 1201, two lines of the same color are formed within one rotation of a developing roller 13*a* (see FIG. 1), and the distance between the two lines is L/2, wherein L is the length of one rotation of the developing roller 13*a*. The positions of the two lines within one rotation of the developing roller 13*a* are different from color to color. The reason for this arrangement will be described later.

The toner patterns 1202 for detection of color misalignment in the main-scanning direction are stripe patterns, each of which comprises lines slanting from the sub-scanning direction Z at an angle of 45 degrees. Each of the toner patterns 1202 comprises four lines, that is, a line of the color K, a line of the color C, a line of the color M and a line of the color Y formed sequentially in the moving direction Z of the intermediate transfer belt 21. Each of the lines has a width of 24 dots.

Figure 13:
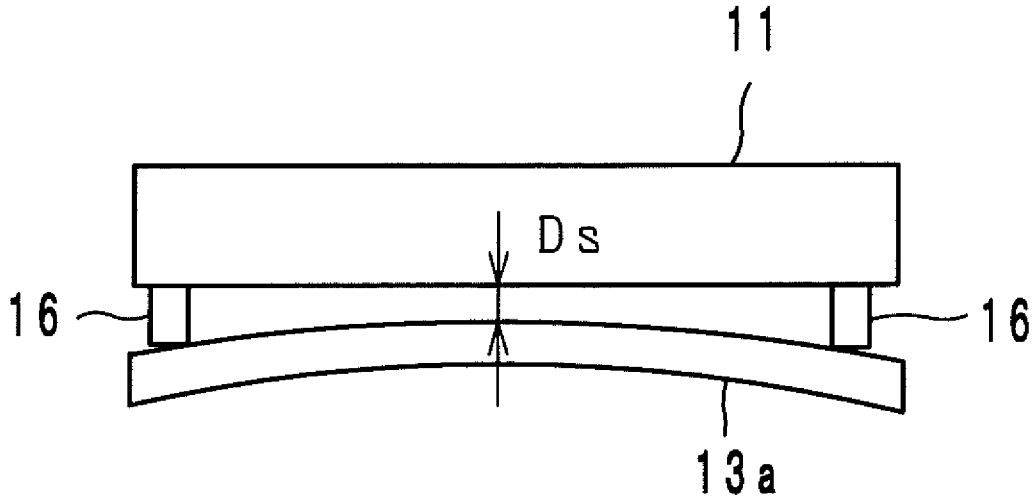
FIG. 13 is an illustration showing the distance between the developing roller and the photosensitive drum.

Now, the positions of the lines in each of the toner patterns 1201 are described. As shown in the magnified view of FIG. 6, two lines of the same color are formed at the minimum density point and at the maximum density point, respectively, within one rotation of the developing roller 13*a*. The reason for the presence of the minimum density point and the maximum density point is described below. In each of the process units 10, as shown by FIG. 13, the developing roller 13*a* is disposed to face to the photosensitive drum 11 via rollers 16 disposed at both sides of the photosensitive drum 11. When the developing roller 13*a* has distortion or eccentricity, the distance Ds between the developing roller 13*a* and the photosensitive drum 11 periodically changes, and there occur a maximum distance point where the distance Ds is the maximum and a minimum distance point where the distance Ds is the minimum. The minimum distance point is the maximum density point, and the maximum distance point is the minimum density point.

Once the maximum density point within one rotation of the developing roller 13*a* is detected, the opposite point (the point at an angle of 180 degrees to the maximum density point in the direction of rotation) of the developing roller 13*a* is specified as the minimum density point. Now, referring to FIG. 12, a process of detecting the maximum density point is described. In this process, a potential difference between the developing roller 13*a* and the photosensitive drum 11 is made, thereby causing a leak current, and the maximum density point is detected while the leak current is monitored. Since the maximum density point is a point where the distance Ds is the minimum, the maximum density point is a point where the leak current is the maximum during one rotation of the developing roller 13*a*.

Figure 12:
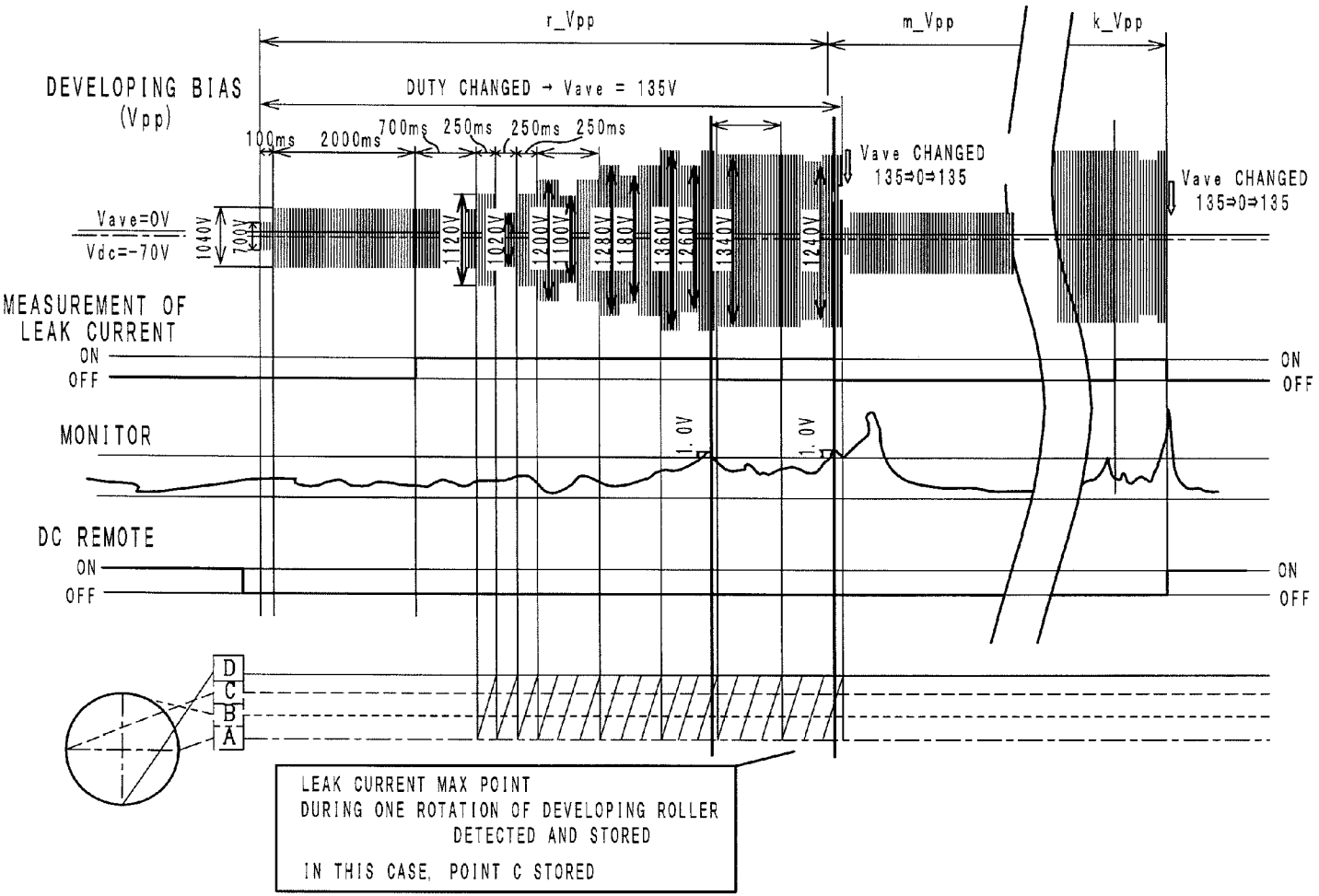
FIG. 12 is a graph showing a method for specifying the points where the distance between a developing roller and a photosensitive drum is the maximum and the point where the distance between the developing roller and the photosensitive drum is the minimum.

In the case of FIG. 12, first, a developing bias voltage composed of a direct current Vdc of 70V and an alternate current Vpp of 750V is applied to the developing roller 13*a*, and then, the developing bias voltage is gradually raised. This is to stabilize a leak current detection circuit for detecting the leak current. Further, during a period wherein one level of developing bias voltage Vpp is to be applied, the voltage Vpp is dropped by 100V temporarily, so that the leak voltage can be monitored accurately. In the case of FIG. 12, the peak point that is higher than a reference leak value by 1V or more is detected as the maximum density point. As the leak current is increasing, the dynamic range becomes wider, and more precise detection becomes possible. Also, the monitoring is continued at least until the maximum density point is detected twice, and thereby, more precise detection becomes possible. In the case of FIG. 12, a point C of the developing roller 13*a* is detected as the maximum density point.

As shown in the magnified view of the toner pattern 1201_rb of FIG. 6, one of the lines K is formed on the maximum density point C. The other line K is formed on the point A that is opposite (at an angle of 180 degrees) to the point C. As mentioned, the point A that is opposite to the maximum density point C is the minimum density point. In the color registration control, if lines of different colors overlap with one another, precise detection will be impossible. In order to prevent overlaps of different colors, an area corresponding to the length L of one rotation of the developing roller 13*a* is allocated for formation of two lines of each color.

Now, referring to FIG. 7, the developing bias voltage for formation of the toner patterns 1201 and 1202 is described. For the sections A, B, C and D divided to traverse the sub-scanning direction, the developing bias voltage is raised to Vave_a, Vave_b, Vave_c and Vave_d intermittently. These four levels of the voltage are determined on the basis of the state of the image forming apparatus (the initial developing bias voltage, the humidity and other environmental conditions, the total operation hours, etc.).

Next, how to use the outputs of the optical sensors SE1 is described. The outputs of the optical sensors SE1 were adjusted beforehand in the sensor light quantity control, such that the sensors SE1 output a target value when the sensors SE1 detect the surface of the intermediate transfer belt 21. For the toner adherence control of a color, the minimum output values from the optical sensors SE1 during detection of lines of the color are used. For example, referring to FIG. 8, the minimum output value Kmin is used for the toner adherence control of K, and the minimum output value Cmin is used for the toner adherence control of C.

For the color registration control, the times when the centers of lines of the toner patterns pass the detection points of the sensors SE1 are used. As shown in FIG. 8, while the sensor SE1 detects a line of a stripe toner pattern, the sensor SE1 outputs a wave including a falling portion that falls from the output value indicating the surface of the intermediate transfer belt 21 (maximum value) to a minimum value indicating the thickest point of the line and a rising portion that rises from the minimum value to the output value indicating the surface of the intermediate transfer belt 21 again. In the falling portion and the rising portion of the wave, the times when the optical sensor SE1 outputs a mid value between the maximum value and the minimum value are specified. For example, while the sensor SE1 detects a line of the color K, the sensor SE1 outputs a mid value at the times a_k and b_k, and while the sensor SE1 detects a line of the color C, the sensor SE1 outputs a mid value at the times a_c and a_b. By using the times when the optical sensor SE1 outputs the mid value, the time when the center of a line passes the detection point of the optical sensor SE1 is figured out. For example, the time when the center of a line of K is detected by the optical sensor SE1 is calculated by (a_k+b_k)/2, and the time when the center of a line of C is detected by the optical sensor SE1 is calculated by (a_c+a_b)/2.

Next, a process of calculating optimal developing bias voltages for the four colors is described. In the toner adherence control, developing bias voltages to achieve predetermined target adherence amounts for the four respective colors are calculated. For this purpose, the detection results of the toner patterns 1201 and 1202 outputted from the optical sensors SE1 are treated in the following way. In each of the sections A, B, C and D, that is, on each of the four bias voltage levels (see FIG. 7), there are six lines each of the same color, and with respect to a color, six minimum output values are obtained. Then, the six minimum output values are averaged, and from the average minimum output value for the color, the amount of toner adhering to a solid image of the color is calculated. For the calculation of the toner adherence amount, a calculating formula or a look-up table stored in the control section 50 is used. In this way, with respect to each of the four colors, four values can be obtained as the amounts of toner adhering to the solid images of the color formed under different conditions of the four bias voltage levels.

Figure 14:
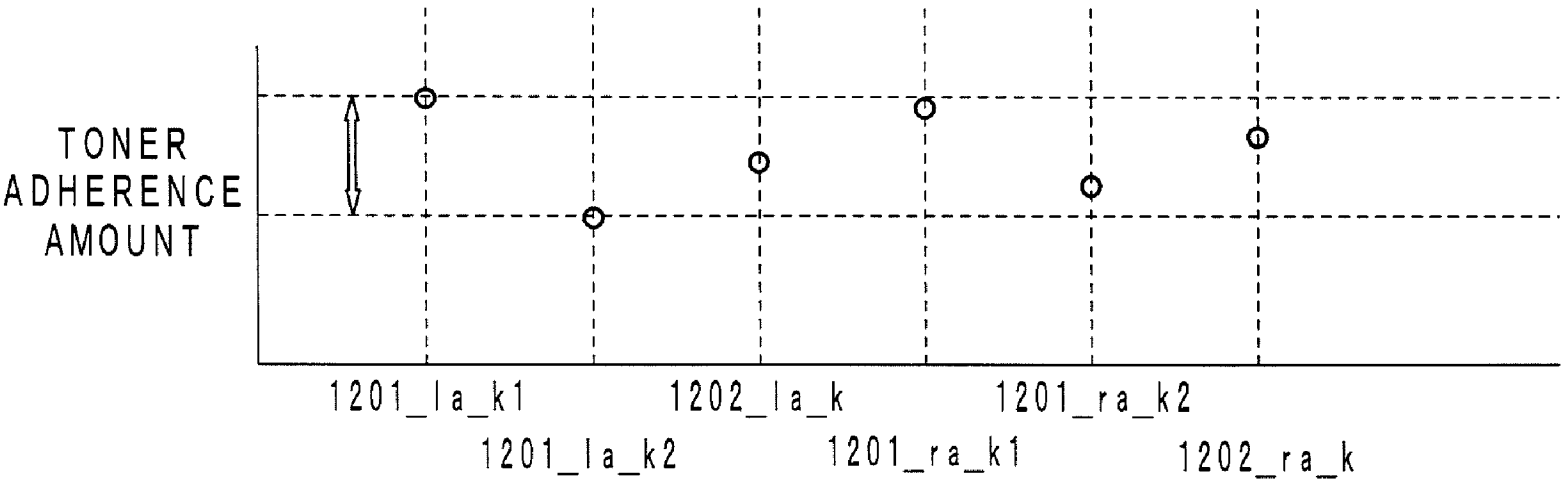
FIG. 14 is a graph showing the amounts of toner adhering to the lines of a color in a pair of toner patterns of the second exemplary formation of toner patterns, the amounts calculated from output values of the optical sensors.
Figure 15:
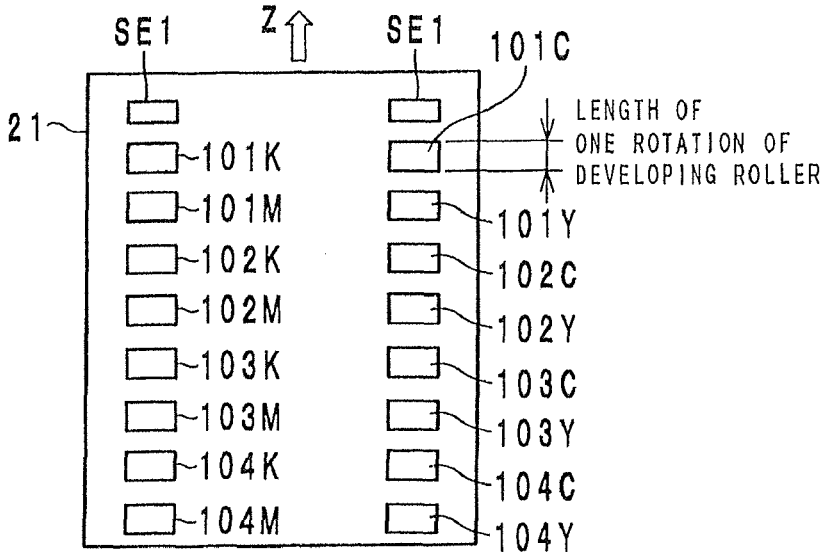
FIG. 15 is a plan view showing formation of toner patterns used for toner adherence amount control in a conventional image forming apparatus.
Figure 16:
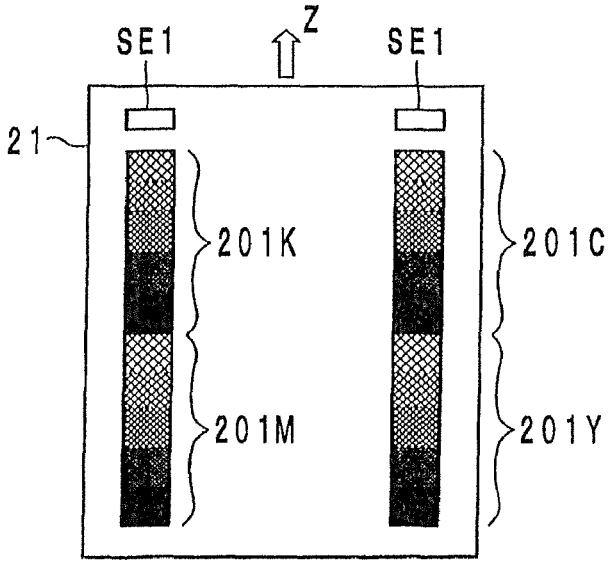
Prior Art F I G. 16
FIG. 16 is a plan view showing formation of toner patterns used for halftone density control in a conventional image forming apparatus.
Figure 17:
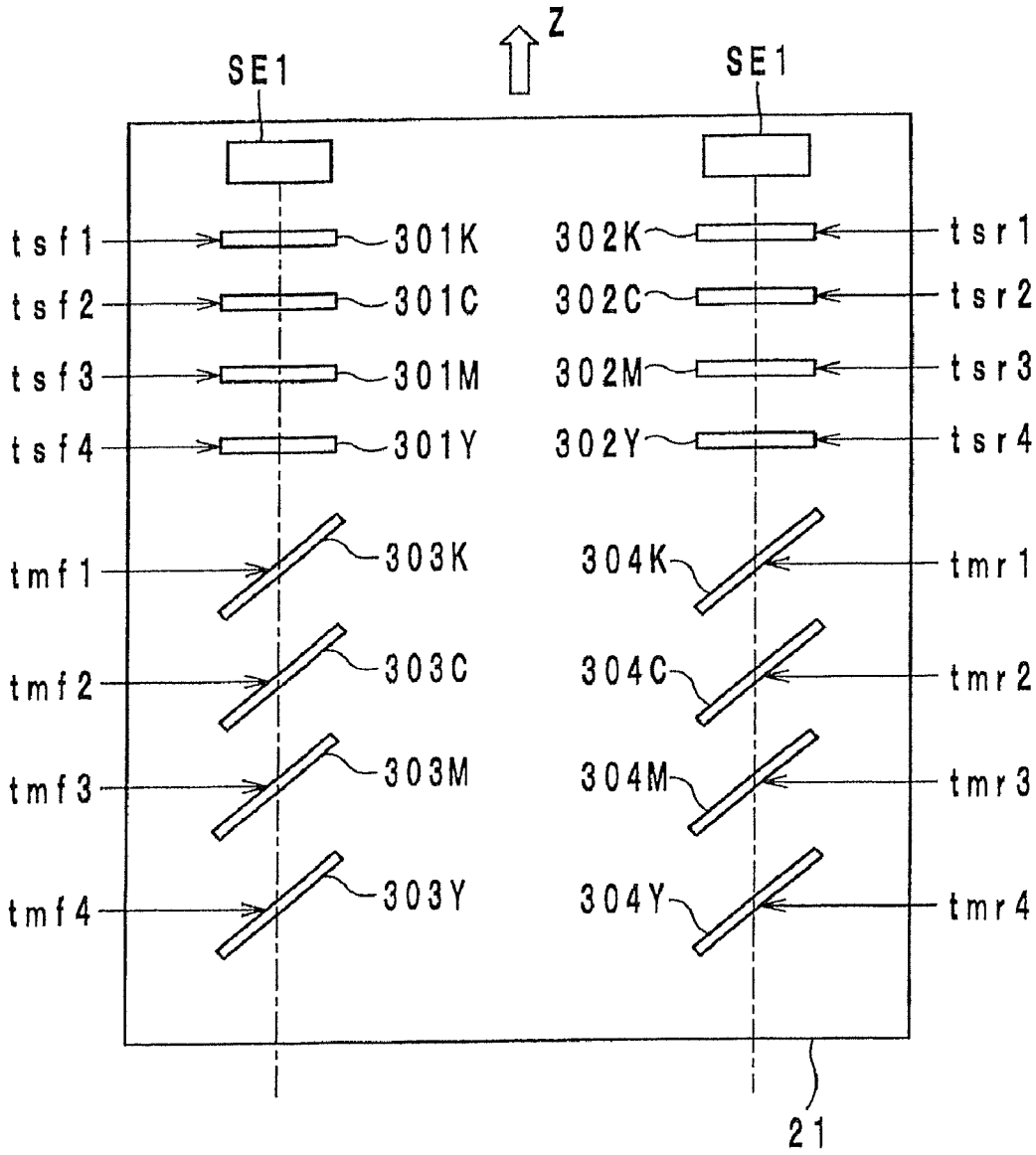
FIG. 17 is a plan view showing formation of toner patterns used for color registration control in a conventional image forming apparatus.
Figure 18:
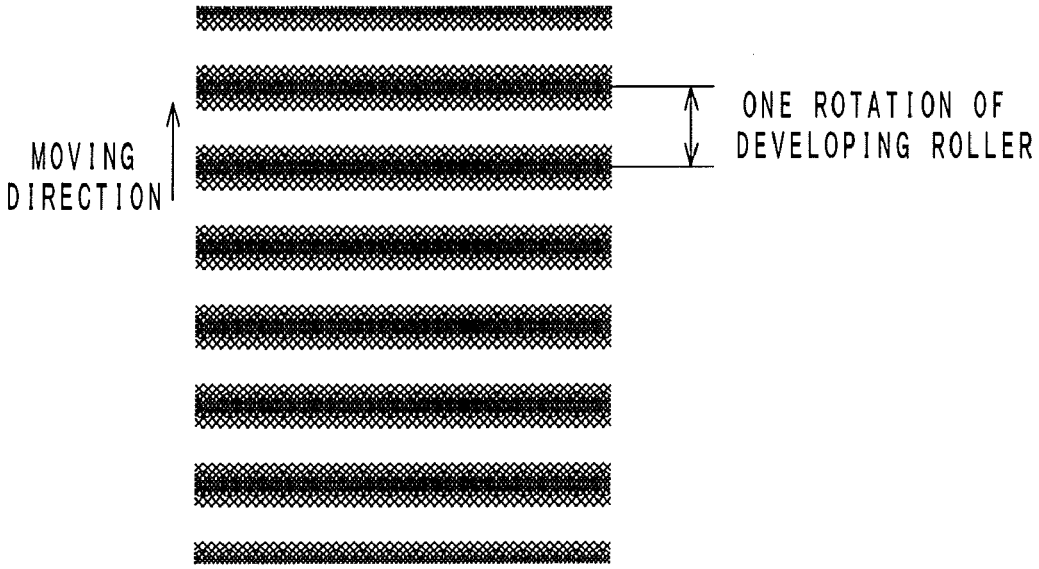
FIG. 18 is a plan view schematically showing density unevenness due to distortion/eccentricity of a developing roller.

Meanwhile, from the six minimum output values for a color obtained on each bias voltage level, the amounts of toner adhering to the respective lines of the same color formed under the same condition of the same developing bias voltage level are calculated by using the calculating formula or the look-up table. FIG. 14 shows the toner adherence amounts of K calculated from the minimum output values of the sensors SE1 while the sensors SE1 detect the toner patterns 1201_*la*, 1201_*ra*, 1202_*la* and 1202_*ra* formed under the same condition of the same bias voltage level. In the case of FIG. 14, the maximum toner adherence amount is marked by the line 1201_*la*_*k*1, and the minimum toner adherence amount is marked by the line 1201_*ra*_*k*2.

From the maximum toner adherence amount and the minimum toner adherence amount on the same bias voltage level, periodical density unevenness due to distortion/eccentricity of the developing roller 13*a* can be recognized. The difference between the maximum toner adherence amount and the minimum toner adherence amount (the degree of density unevenness) is within a tolerable range, there is no problem. However, if the degree of density unevenness is beyond the tolerable range, the image forming apparatus shall be forcibly stopped, and a trouble warning shall be raised so as to warn the user to take an action to return the apparatus into a normal state.

In the case wherein the degree of density unevenness is beyond the tolerable range, alternatively, the target toner adherence amount may be heightened. As shown by FIG. 9, it is likely that the sensitivity of the optical sensors SE1 becomes lower as the toner adherence amount increases. Accordingly, by heightening the target toner adherence amount, the density unevenness in a solid pattern can be suppressed within the tolerable range.

Next, referring to FIGS. 10*a* and 10*b*, a process of calculating an optimal developing bias voltage for each color from the four toner adherence amounts on the four developing bias voltage levels is described. FIGS. 10*a* and 10*b* show the relationship between the developing bias voltage Vave and the amount of deposited toner with respect to formation of black (K) images. The voltages Vave_a to Vave_d are the developing bias voltages applied in the sections A to D, respectively, in the black (K) image process unit 10K. FIG. 10*a* shows a case wherein the optimal bias voltage (Vave_trg) for achieving the target toner adherence amount is within the range from Vave_a to Vave_d. FIG. 10*b* shows a case wherein the optimal bias voltage (Vave_trg) for achieving the target toner adherence amount is out of the range from Vave_a to Vave_d.

In the case of FIG. 10*a*, by performing straight-line approximation and interpolation within a range from Vave_c and Vave_d, the optimal developing bias voltage (Vave_trg) for achieving the target toner adherence amount is figured out. In the case of FIG. 10*b*, by performing straight-line approximation and interpolation beyond the level Vave_d, the optimal developing bias voltage (Vave_trg) for achieving the target toner adherence amount is figured out. The straight-line approximation is carried out by using a method of least squares.

The stripe toner patterns are also used for the color registration control. Now, a process of calculating the writing start times in the main-scanning direction and a process of calculating the writing start times in the sub-scanning direction for the respective colors are described. From the positions of the centers of the respective lines in the toner patterns calculated in the above-described way, the writing start times in the main-scanning direction and in the sub-scanning are calculated.

The writing start times in the sub-scanning direction of the respective colors are calculated by using detection results of the eight toner patterns 1201. First, in each of the eight toner patterns 1201, the amount of misalignment of the center of C from the center of K in the sub-scanning direction, the amount of misalignment of the center of M from the center of K in the sub-scanning direction and the amount of misalignment of the center of Y from the center of K in the sub-scanning direction are calculated. Accordingly, by detecting the eight toner patterns 1201, with respect to each of the colors C, M and Y, eight values are obtained as the amounts of misalignment from the color K in the sub-scanning direction. Next, by averaging the eight values, the average amount of misalignment of each of the colors C, M and Y from the color K in the sub-scanning direction is calculated. Then, with respect to each of the colors C, M and Y, on the basis of the average amount of misalignment, the writing start time in the sub-scanning direction is determined.

Now, the calculation for the amount of misalignment in the sub-scanning direction of a color from black K in one toner pattern 1201 is described, exemplifying the misalignment of the color C from the color K. As shown in the magnified view of the toner pattern 1201_*rb* of FIG. 6, each of the toner patterns 1201 has eight lines of the colors K, C, M and Y. Specifically, two lines of K, two lines of C, two lines of M and two lines of Y are arranged in this order in the moving direction Z of the intermediate transfer belt 21. In the two sequential lines of the same color, the first line is provided with a reference number 1, and the second line is provided with a reference number 2. The center of the line C1 is compared with the center of the line K1, and the center of the line C2 is compared with the center of the line K2.

In this way, two values can be obtained as the amounts of misalignment of the color C from the color K in the toner pattern. These two values are averaged, and the average is used as the amount of misalignment in the sub-scanning direction of C from K in the toner pattern. In the same way, in one toner pattern, the amount of misalignment of M from K in the sub-scanning direction and the amount of misalignment of Y from K in the sub-scanning direction are calculated.

The writing start times in the main-scanning direction of the respective colors are calculated by using detection results of both the eight toner patterns 1201 and the eight toner patterns 1202. Specifically, first, in a pair of toner patterns 1201 and 1202 (e.g., 1201_*la* and 1202_*la*), the amount of misalignment of the center of C from the center of K in the main-scanning direction, the amount of misalignment of the center of M from the center of K in the main-scanning direction and the amount of misalignment of the center of Y from the center of K in the main-scanning direction are calculated. By performing this calculation in all the eight pairs of toner patterns 1201 and 1202, eight values are obtained as the amounts of misalignment of each of the colors C, M and Y from the color K. Next, by averaging the eight values, the average amount of misalignment of each of the colors C, M and Y from the color K in the main-scanning direction is calculated. Then, with respect to each of the colors, on the basis of the average amount of misalignment, the writing start time in the main-scanning direction is determined.

Now, the calculation for the amount of misalignment in the main-scanning direction of a color from black K in a pair of toner patterns 1201 and 1202 is described. As shown by the magnified view of the toner pattern 1202_*rd* of FIG. 6, each of the toner patterns 1202 comprises lines of the colors K, C, M and Y slanting from the belt moving direction (sub-scanning direction) Z at an angle of 45 degrees. Therefore, by measuring the distance (time difference) between a line under examination and a reference line, the direction and the amount of misalignment of the line under examination from the reference line can be figured out. In examining a line of a color, the line of the same color formed immediately before the line is used as the reference line. For example, when a line of a color in the toner pattern 1202_*rd* is examined, the line of the same color in the toner pattern 1201_*rd* is used as the reference line.

This is described in more details by using the numbers specifying the respective lines in each of the toner patterns in the same way as described in connection with the calculation of the writing start times in the sub-scanning direction. For example, when the line 1202_*rd*_K is examined, the line 1201_*rd*_K2 is used as the reference line, and when the line 1202_*rd*_C is examined, the line 1201_*rd*_C2 is used as the reference line. When the line 1202_*rd*_M is examined, the line 1201_*rd*_M2 is used as the reference line, and when the line 1202_*rd*_Y is examined, the line 1201_*rd*_Y2 is used as the reference line. If the distance between the line under examination and the reference line is longer than a target value, the line under examination is judged to be misaligned in the right in FIG. 6. If the distance between the line under examination and the reference line is shorter than the target value, the line under examination is judged to be misaligned in the left in FIG. 6. In this way, in a pair of toner patterns 1201 and 1202, with respect to each of the four colors Y, M, C and K, the amount of misalignment in the main-scanning direction between lines of the same color is calculated. Thereafter, the amount of misalignment between lines of the color C, the amount of misalignment between lines of the color M and the amount of misalignment between lines of the color Y are compared with the amount of misalignment of lines of the color K. In this way, in a pair of toner patterns 1201 and 1202, the amounts of misalignment of the colors C, M and Y from the color K in the main-scanning direction are obtained.

The writing start point of the first line of each of the colors C, M and Y is adjusted on the basis of the amount of misalignment of the color from the color K in the sub-scanning direction calculated in the above-described method, thereby achieving color registration in the sub-scanning direction. In the same way, the writing start point of each of the colors C, M and Y is adjusted on the basis of the amount of misalignment of the color from the color K in the main-scanning direction calculated in the above-described method, thereby achieving color registration in the main-scanning direction. Further, when there are errors in the length of main scanning, the clock frequency is changed to correct the length of main scanning, and the writing start points of the colors in the main-scanning direction are adjusted also on the basis of the change of the clock frequency.

As described above, in the image forming apparatus according to the embodiment, in the image stabilization control, the same toner patterns are used for calculation of the toner adherence amount and the toner adherence position, and therefore, the toner consumption, the number of sensors and the time for the image stabilization control can be reduced. Accordingly, the image forming apparatus can carry out the image stabilization control, especially the toner amount control and the color registration control at low cost by using less toner and a small number of sensors.

Although the present invention has been described with reference to the preferred embodiments above, it is to be noted that various changes and modifications are possible to those who are skilled in the art. Such changes and modifications are to be understood as being within the scope of the present invention.

What is claimed is:

1. An image forming apparatus comprising:

an image bearing member that moves at a specified speed;

a toner pattern forming section for forming toner patterns of a specified type on the image bearing member under specified image forming conditions;

a toner pattern detection member for detecting the toner patterns formed on the image bearing member;

a toner adherence amount varying section for varying a target amount of toner to adhere to the toner patterns; and a control section that calculates a toner adherence amount and a toner adherence position from detection results outputted from the toner pattern detection member and that performs image stabilization control to adjust the image forming conditions based on the calculation results, wherein in the image stabilization control, the control section uses detection results of the same toner patterns both to calculate the toner adherence amount and to calculate the toner adherence position.

2. An image forming apparatus according to claim 1, wherein each of the toner patterns has a length in a moving direction of the image bearing member that is equal to or shorter than a length of one rotation of a developing roller.

3. An image forming apparatus according to claim 1, wherein the control section controls the toner pattern forming section to form stripe toner patterns, each of which comprises lines extending in a direction perpendicular to the moving direction of the image bearing member.

4. An image forming apparatus according to claim 3, further comprising:

a photosensitive member on which an electrostatic latent image is formed; and a developing roller for applying toner onto the electrostatic latent image to develop the electrostatic latent image into a toner image, wherein the control section controls the toner pattern forming section to form toner patterns, each of which has a length in the moving direction of the image bearing member that is equal to or longer than a length of one rotation of the developing roller.

5. An image forming apparatus according to claim 1, further comprising:

a photosensitive member on which an electrostatic latent image is formed;

a developing roller for applying toner onto the electrostatic latent image to develop the electrostatic latent image into a toner image; and a distance detection member for detecting a distance between the photosensitive member and the developing roller, wherein the control section controls the toner pattern forming section to form toner patterns, each of which covers a point where the distance between the photosensitive member and the developing roller is a maximum and a point where the distance between the photosensitive member and the developing roller is a minimum.

6. An image forming apparatus according to claim 5, wherein the distance detection member generates a potential difference between the photosensitive member and the developing roller, thereby causing a leak current between the photosensitive member and the developing roller, and measures the leak current.

7. An image forming apparatus according to claim 1, wherein the toner pattern detection member comprises a light emitting element for irradiating the toner patterns with light, and a light receiving element for receiving light reflected from the toner patterns.

8. An image forming apparatus comprising:

an image bearing member that moves at a specified speed;

a toner pattern forming section for forming toner patterns of a specified type on the image bearing member under specified image forming conditions;

a toner pattern detection member for detecting the toner patterns formed on the image bearing member;

a toner amount varying section for varying a target amount of toner to adhere to the toner patterns; and a control section that calculates a toner adherence amount from detection results of the toner pattern detection member and that performs image stabilization control to adjust the image forming conditions based on the calculation result, wherein for the image stabilization control, the control section controls the toner pattern forming section to form stripe toner patterns, each of which comprises lines having a largest dimension that extends in a direction perpendicular to a moving direction of the image bearing member.

9. An image forming apparatus according to claim 8, further comprising:

a photosensitive member on which an electrostatic latent image is formed; and a developing roller for applying toner onto the electrostatic latent image to develop the electrostatic latent image into a toner image, wherein the control section controls the toner pattern forming section to form stripe toner patterns, each of which has a length in the moving direction of the image bearing member that is equal to or longer than a length of one rotation of the developing roller, the lines in each of the stripe toner patterns being formed under the same image forming conditions.

10. An image forming apparatus according to claim 8, wherein the toner pattern detection member comprises a light emitting element for irradiating the toner patterns with light, and a light receiving element for receiving light reflected from the toner patterns.

11. An image stabilization method performed in an image forming apparatus, said method comprising:

forming toner patterns of a specified type on an image bearing member under specified image forming conditions while the image bearing member is moving at a specified speed;

detecting the toner patterns formed on the image bearing member;

varying a target amount of toner to adhere to the toner patterns; and calculating a toner adherence amount and a toner adherence position from detection results of the toner patterns and adjusting the image forming conditions based on the calculation result, wherein in order to adjust the image forming conditions, detection results of the same toner patterns are used both to calculate the toner adherence amount and to calculate the toner adherence position.

12. An image stabilization method according to claim 11, wherein each of the toner patterns has a length in a moving direction of the image bearing member that is equal to or shorter than a length of one rotation of a developing roller.

13. An image stabilization method according to claim 11, wherein each of the toner patterns is a stripe pattern comprising lines extending in a direction perpendicular to a moving direction of the image bearing member.

14. An image stabilization method according to claim 13, said method further comprising:

forming an electrostatic latent image on a photosensitive member; and applying toner onto the electrostatic latent image formed on the photosensitive member with a developing roller, wherein each of the toner patterns is formed to have a length in the moving direction of the image bearing member that is equal to or longer than a length of one rotation of the developing roller.

15. An image stabilization method according to claim 11, said method further comprising:

forming an electrostatic latent image on a photosensitive member;

applying toner onto the electrostatic latent image formed on the photosensitive member with a developing roller; and detecting a distance between the photosensitive member and the developing roller, wherein each of the toner patterns is formed to cover a point where the distance between the photosensitive member and the developing roller is a maximum and a point where the distance between the photosensitive member and the developing roller is a minimum.

16. An image stabilization method according to claim 15, wherein the distance between the photosensitive member and the developing roller is detected by generating a potential difference between the photosensitive member and the developing roller, thereby causing a leak current between the photosensitive member and the developing roller, and by measuring the leak current.

17. An image stabilization method performed in an image forming apparatus, said method comprising:

forming stripe toner patterns on an image bearing member under specified image forming conditions while the image bearing member is moving at a specified speed such that each of the stripe toner patterns comprises lines having a largest dimension that extends in a direction perpendicular to a moving direction of the image bearing member;

detecting the toner patterns formed on the image bearing member;

varying a target amount of toner to adhere to the toner patterns; and calculating a toner adherence amount from detection results of the toner patterns and adjusting the image forming conditions based on the calculation result.

18. An image stabilization method according to claim 17, further comprising:

forming an electrostatic latent image on a photosensitive member; and applying toner onto the electrostatic latent image with a developing roller, wherein each of the stripe toner patterns is formed to have a length in the moving direction of the image bearing member that is equal to or longer than a length of one rotation of the developing roller, the lines in each of the stripe toner patterns being formed under the same image forming conditions.

19. An image forming apparatus according to claim 8, wherein each stripe toner pattern includes at least four lines.

20. An image stabilization method according to claim 17, wherein each stripe toner pattern includes at least four lines.

* * * * *